US008517598B1

(12) United States Patent
Lowell

(10) Patent No.: US 8,517,598 B1
(45) Date of Patent: Aug. 27, 2013

(54) REMOVABLE BAFFLES FOR MIXING VESSEL

(75) Inventor: Mark D. Lowell, Gloucester, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 975 days.

(21) Appl. No.: 12/587,317

(22) Filed: Sep. 22, 2009

(51) Int. Cl.
*B01F 7/00* (2006.01)

(52) U.S. Cl.
USPC ..... 366/307; 366/326.1; 366/337

(58) Field of Classification Search
USPC ..... 366/302–304, 307, 325.92, 326.1, 366/336–339
See application file for complete search history.

(56) References Cited

U.S. PATENT DOCUMENTS

| | | | | |
|---|---|---|---|---|
| 975,380 | A | 11/1910 | Berntson | |
| 1,020,814 | A | 3/1912 | Fay | |
| 2,064,861 | A | 12/1936 | Stroud | |
| 4,244,531 | A | 1/1981 | Szegvari | |
| 4,298,576 | A | 11/1981 | Thyret et al. | |
| 4,332,482 | A * | 6/1982 | Engler | 366/130 |
| 4,747,696 | A | 5/1988 | McCrory et al. | |
| 4,929,088 | A * | 5/1990 | Smith | 366/337 |
| 4,951,262 | A | 8/1990 | Phillippi et al. | |
| 6,769,800 | B1 | 8/2004 | Young | |
| 7,229,204 | B2 * | 6/2007 | Haskell | 366/233 |
| 2003/0227817 | A1 | 12/2003 | Martel et al. | |
| 2005/0007875 | A1 | 1/2005 | Reinemuth | |
| 2007/0081419 | A1 | 4/2007 | Mou | |

* cited by examiner

*Primary Examiner* — Walter D Griffin
*Assistant Examiner* — Timothy Cleveland
(74) *Attorney, Agent, or Firm* — Fredric J. Zimmermar

(57) ABSTRACT

A mixing vessel may include a container having a bottom with a removable plate fixed to the bottom. The removable plate may include one or more slots for inserting baffles therein. A flexible baffle insert may include a retaining band having inner and outer opposing surfaces. A plurality of baffles may extend inwardly from the inner surface of the retaining band.

10 Claims, 9 Drawing Sheets

REMOVABLE BAFFLES FOR MIXING VESSEL

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates, in general, to mixing vessels, and, in particular, to mixing vessels with easily interchangeable baffles.

BACKGROUND OF THE INVENTION

Mixing vessels may be used in a variety of commercial and industrial processes. A variety of materials may be mixed in a mixing vessel. Different materials and different processes may require different amounts of shear and flow patterns to properly mix the ingredients, maintain the ingredients in suspension, and circulate the ingredients within the vessel. The size, shape, location, orientation, and rotational speed of the mixing vessel impeller may be factors in producing specific flow patterns tailored for a particular product.

A mixing vessel without baffles may not produce enough shear or turbulence to mix the ingredients. Therefore, many mixing vessels may include fixed baffles that may influence the mixing action and flow patterns. The number, size, location and geometry of baffles may vary widely, generating both localized high shear between the baffle and impeller blades, and generating circulating currents that may promote the homogeneity and suspension of ingredients. A configuration of impeller and baffles that may be optimized to produce one product may be unsuitable for a different product.

The flow patterns and circulating currents may also be influenced by the shape of the vessel itself. Typically, a vessel having a concave bottom may produce better vertical dispersion because the liquid may be slung out radially from the impeller and may be gently turned upward when the liquid moves toward the vessel wall. Flat-bottomed mixing vessels may not do this function nearly as well, and may have very poor flow patterns. Acceptable flow patterns and methods of mixing a material may be discovered by adding and experimenting with various types of baffles.

In the past, new mixing vessels with optimized geometry were constructed for, and exclusively dedicated to, a specific process or product. As an alternative, existing plain mixing vessels that were, at first, completely unsuitable for a particular process, were retrofitted by adding permanently welded baffles. In such mixing vessels, it may be relatively easy and common practice to make small variations in the mixing action and fine tune it to slightly different processes by changing the impeller or its rotational speed. Changing the baffling may have a much larger effect, but it may be costly to construct a new mixing vessel each time one wishes to alter a baffle arrangement. It may also be costly to remove welded baffles and reweld new baffles in a mixing vessel.

In a manufacturing scenario where more than one product is made, for instance, the manufacturer may set up a single production line, and simply switch baffles in the mixing vessels. In a research and development scenario, the effect that each element of geometry has on the mixing process itself, or the effect that each element of geometry has on the quality of the product being produced, may be explored using many physical variations. Baffles that are easily removed and replaced in a mixing vessel may save time, money, and storage space (for multiple variations of mixing vessels), and simplify cleaning and repair of baffles. Thus, a need exists for mixing vessels having easily interchangeable baffles.

In some cases, such as laboratory bench top and glassware size vessels, a mixing vessel having the desired baffle arrangement may not be available commercially. Formulations and mixing procedures for products may be developed and tested in both small and medium scale laboratory mixers before transitioning to high rate production in full size mixing vessels. A manufacturing plant that uses 3000 gallon baffled mixers may have a laboratory where procedures are developed in quart or gallon sized mixers. Thus, there is a need to be able to adapt standard laboratory glassware mixing vessels, for instance, into scale models of larger mixing vessels, by adding baffle kits.

SUMMARY OF THE INVENTION

An aspect of the invention may be a mixing vessel including a container having a bottom. The bottom may include a removable plate fixed thereto. The removable plate may include at least one slot formed therein. A baffle may be inserted in at least one slot.

Another aspect of the invention may be a flexible baffle insert including a retaining band having inner and outer opposing surfaces, and a plurality of baffles extending inwardly from the inner surface of the retaining band. Each baffle may include first and second edges proximate the inner surface of the retaining band. The first proximate edge may form a support joint with the inner surface of the retaining band and the second proximate edge may be displaced inwardly from the first proximate edge.

A further aspect of the invention may be a mixing vessel including a container having a bottom and a generally circular side wall, and a flexible baffle insert disposed in the container.

Another aspect of the invention may be a method of making a flexible baffle insert. The method may include providing a thin, flexible material having a retaining band and a plurality of baffles, where the retaining band and the baffles are substantially coplanar. The related method may include bending the baffles along an edge such that the baffles are angled with respect to the retaining band.

The invention will be better understood, and further objects, features, and advantages thereof will become more apparent from the following description of the exemplary embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

Figure 1:
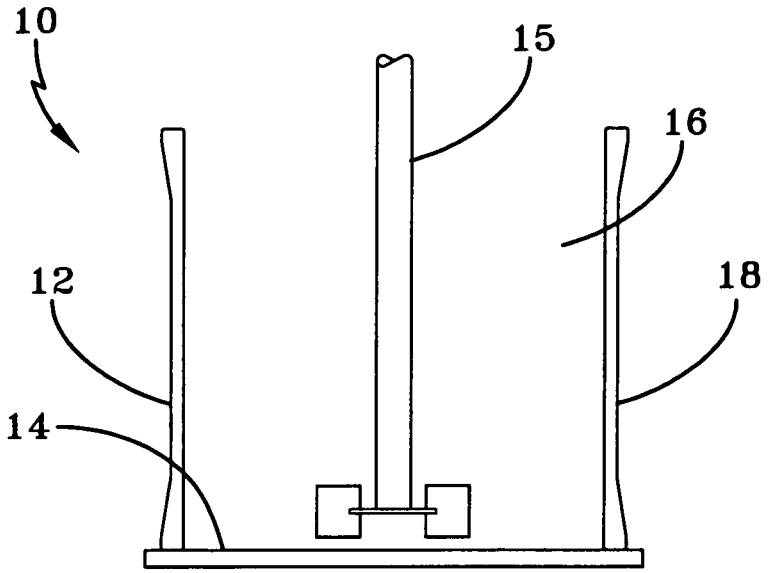
FIG. 1 is a side view of a mixing vessel without baffles.
Figure 2:
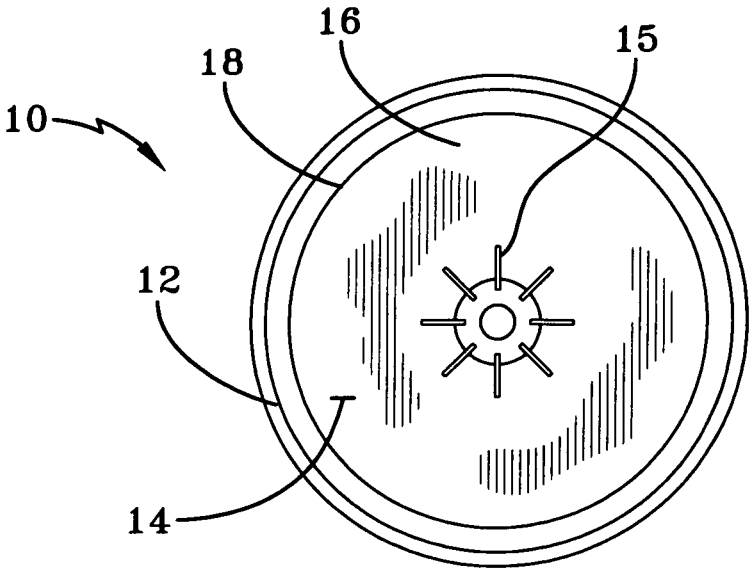
FIG. 2 is a top view of FIG. 1.

FIG. 1 is a side view of a mixing vessel 10 and FIG. 2 is a top view of the mixing vessel 10 shown in FIG. 1. Mixing vessel 10 may be one piece or it may be an assembly including, for example, a container 12 having a bottom 14, side walls 18, and a generally open interior 16. The bottom of the mixing vessel may have any contour or it may be flat as shown in FIG. 1. The shape and location of the impeller 15 may be varied to suit a particular process.

Figure 3A:
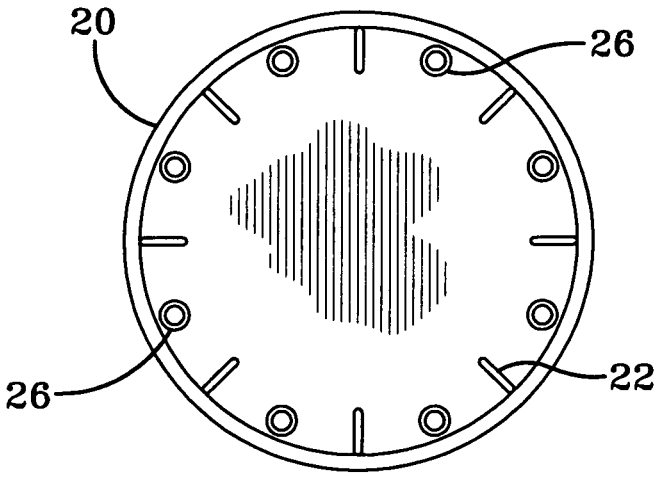
FIGS. 3A and 3B are top and side views, respectively, of a removable plate.
Figure 3B:
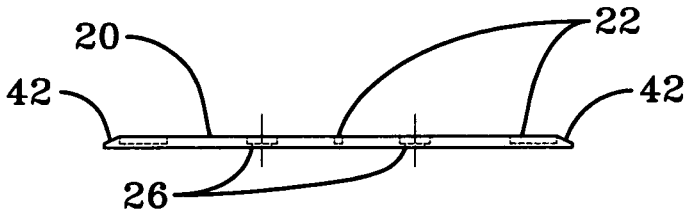

FIGS. 3A and 3B are top and side views, respectively, of one exemplary embodiment of a removable plate 20. Plate 20 may include at least one fastener opening 26 formed therein. Plate 20 may include at least one slot 22 formed therein for receiving a baffle. A periphery of plate 20 may include a beveled edge 42. The shape of the plate 20 and the location of the fastener openings 26 may be varied to suit a particular process.

Figure 4:
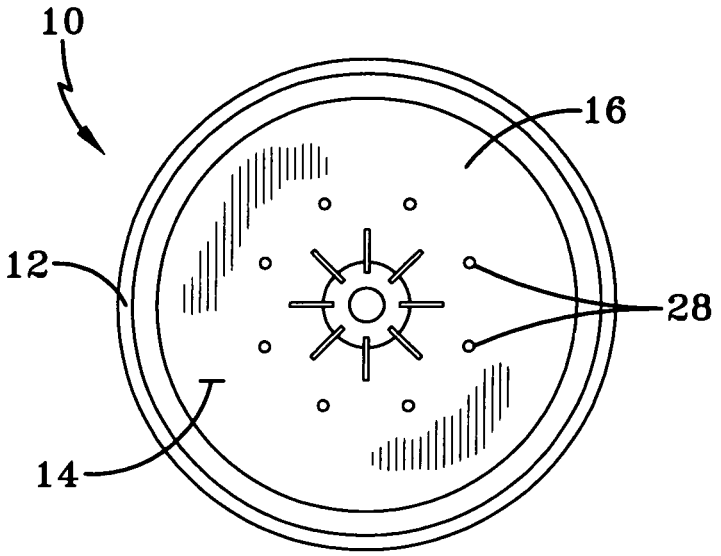
FIG. 4 is a top view of the mixing vessel of FIG. 2 with the removable plate removed.

FIG. 4 is a top view of the mixing vessel 10 of FIG. 2 showing fastener openings 28 that may be formed in bottom 14. Fastener openings 26 in plate 20 may correspond to fastener openings 28 in bottom 14.

Figure 5A:
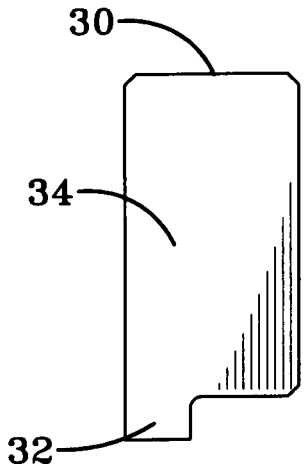
FIGS. 5A and 5B are side and end views, respectively, of an embodiment of a baffle.
Figure 5B:
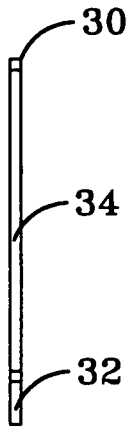

FIGS. 5A and 5B are side and end views, respectively, of an embodiment of a baffle 30. Baffles 30 may have any shape that is needed for a particular process. Baffle 30 may include a tab portion 32 and a body portion 34. Tab portion 32 may be inserted into slot 22 in plate 20. Tab portion 32 and slot 22 may form, for example, a press fit, and may be permanently joined by welding, brazing, or any other joining process. Tab portion 32 and body portion 34 may be substantially planar.

Figure 6A:
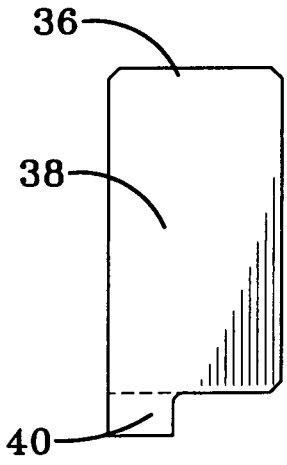
FIGS. 6A and 6B are side and end views, respectively, of another embodiment of a baffle.
Figure 6B:
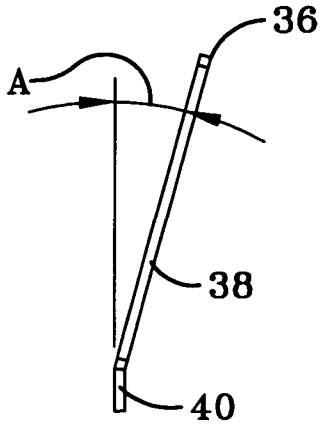

FIGS. 6A and 6B are side and end views, respectively, of another exemplary embodiment of a baffle 36. Baffle 36 may include a tab portion 40 and a body portion 38. Tab portion 40 may be inserted into slot 22 in plate 20. Tab portion 40 and slot 22 may form, for example, a press fit, and may be permanently joined by welding, brazing, or any other joining process. Body portion 38 may be angled with respect to tab portion 40 by angle A. Angle A may be any angle that is needed for a particular process. In the embodiment of FIG. 6B, angle A is about 15 degrees.

Figure 7A:
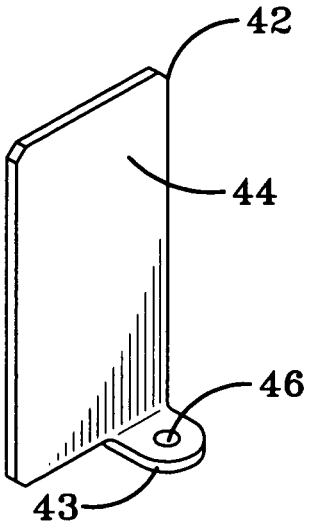
FIGS. 7A, 7B, and 7C are perspective views, respectively, of an embodiment of an independent baffle, an embodiment of a baffle spacer, washer, and fastener, and an embodiment of an independent baffle assembly, prior to disposition in a mixing vessel.

FIG. 7A is an embodiment of an independent baffle 42. Baffle 42 may include a tab portion 43 and a body portion 44. Tab portion 43 may include a fastener opening 46 that corresponds to fastener openings 28 on bottom 14 of the mixing vessel of FIG. 4. Baffles 42 may have any shape that is needed for a particular process.

Figure 7B:
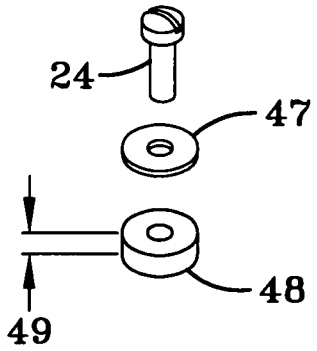

FIG. 7B shows perspective views of a fastener 24, a washer 47, and a spacer 48 of thickness 49. The washer 47 and the spacer 48 may include fastener openings similar to the fastener opening 46 in tab 43 of baffle 42.

Figure 7C:
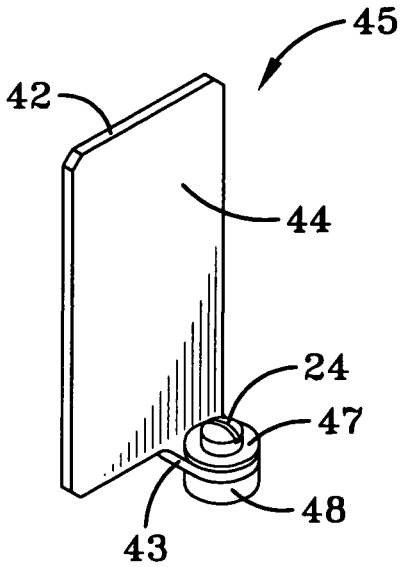

FIG. 7C is a perspective view of a baffle assembly 45 including a spacer 48, a baffle 44, a washer 47 and a fastener 24, prior to disposition on bottom 14 of the mixing vessel of FIG. 4.

Figure 8:
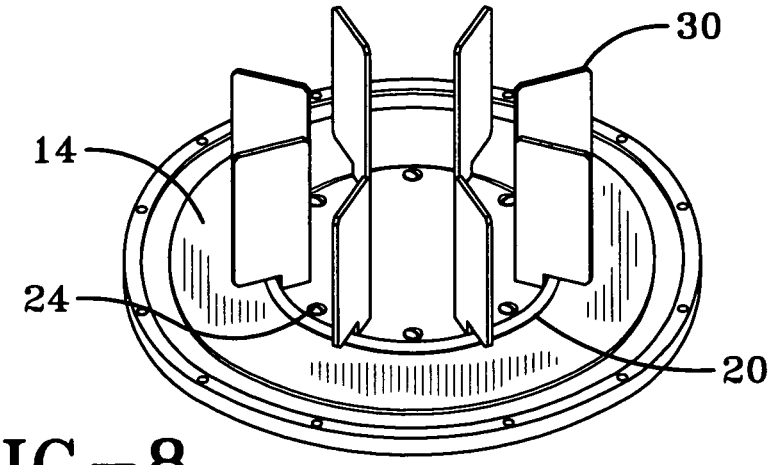
FIG. 8 is a perspective view of a removable plate with baffles as shown in FIGS. 5A and 5B, disposed on the bottom of a mixing vessel.
Figure 9:
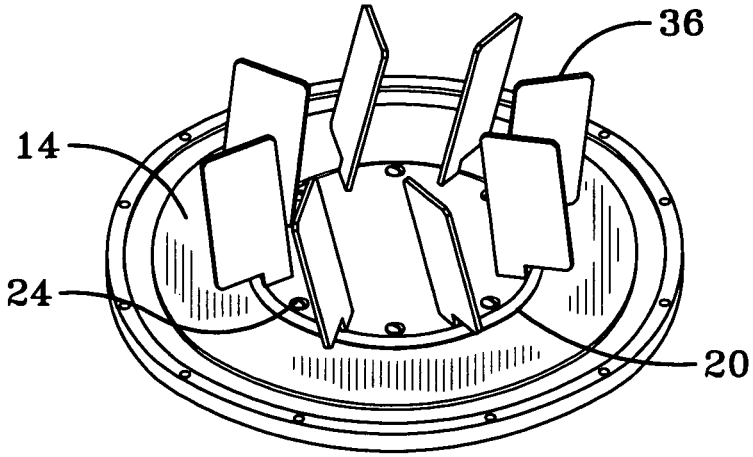
FIG. 9 is a perspective view of a removable plate with baffles as shown in FIGS. 6A and 6B, disposed on the bottom of a mixing vessel.
Figure 10:
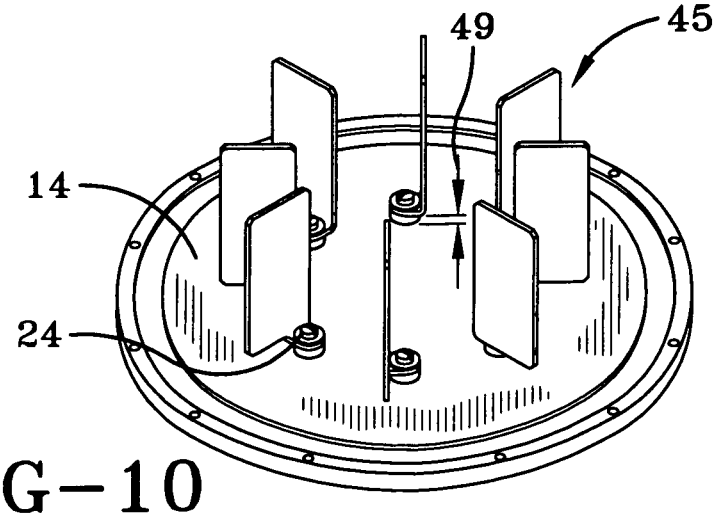
FIG. 10 is a perspective view of independent baffles as shown in FIG. 7C, disposed on the bottom of a mixing vessel.

For clarity, in FIGS. 8, 9, and 10, the side walls 18 of container 12 are not shown. FIG. 8 is a perspective view of a container bottom 14 having a removable plate 20 with baffles 30 as shown in FIGS. 5A and 5B. FIG. 9 is a perspective view of a container bottom 14 having a removable plate 20 with baffles 36 as shown in FIGS. 6A and 6B. Removable plate 20 may be fixed to bottom 14 with fasteners 24.

FIG. 10 is a perspective view of a container bottom 14 having baffle assemblies 45, as shown in FIG. 7C, disposed therein. The baffle assemblies 45 may not require a removable plate 20, and may be disposed anywhere inside the mixing vessel where suitable fastener openings 28 are located. Baffles assemblies 45 may be rotated to any angle about the axes of fasteners 24 as needed to suit a particular process. The spacer thickness 49 may create a gap between the bottom of the assembly 45 and the surface having the fastener opening 28, which may be varied as needed to suit a particular process. The washer 47 and spacer 48 shown in FIG. 7C may form a seal for the fastener openings 28 in bottom 14, shown in FIG. 4.

Any number of baffles may be used as needed for a particular process. In FIGS. 8, 9, and 10, eight baffles are shown.

Figure 11B:
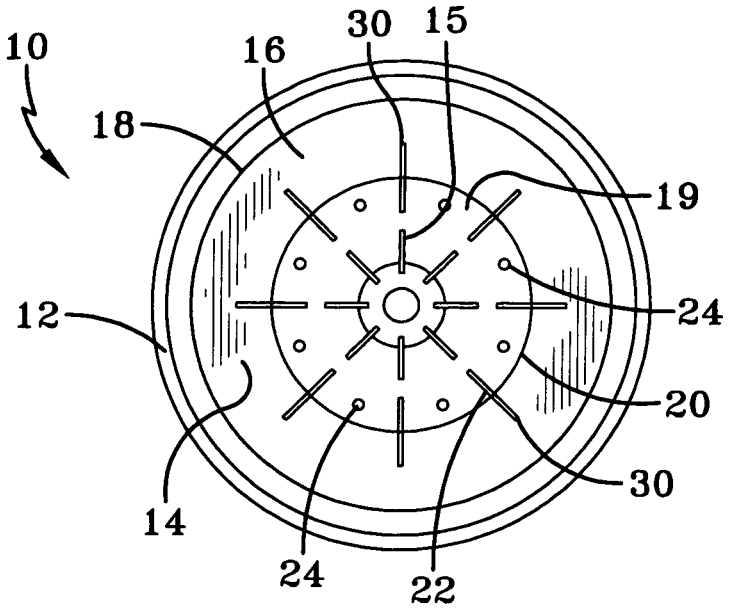
FIGS. 11A and 11B are side and top views, respectively, of a mixing vessel with an embodiment of a removable baffle assembly disposed therein.
Figure 11A:
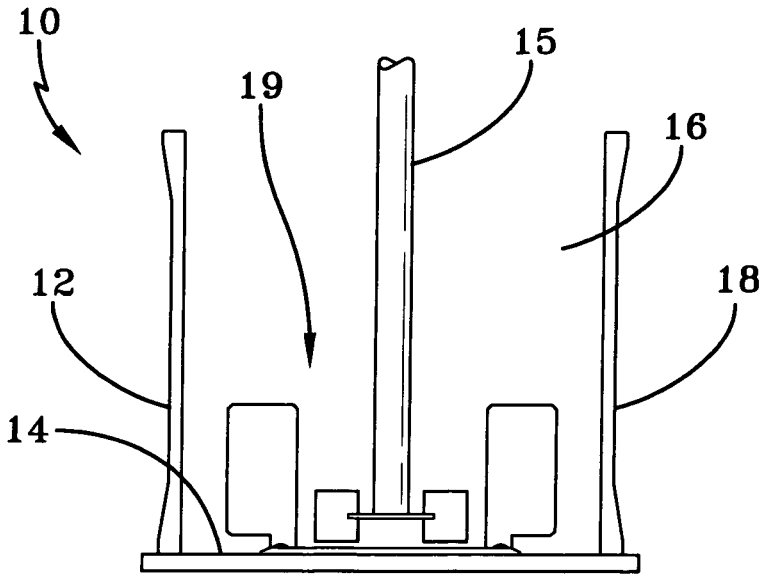

FIGS. 11A and 11B are side and top views, respectively, of the mixing vessel 10 of FIG. 2 including one exemplary embodiment of a removable baffle assembly 19. Assembly 19 includes removable plate 20 and baffles 30, retained by fasteners 24.

Figure 12:
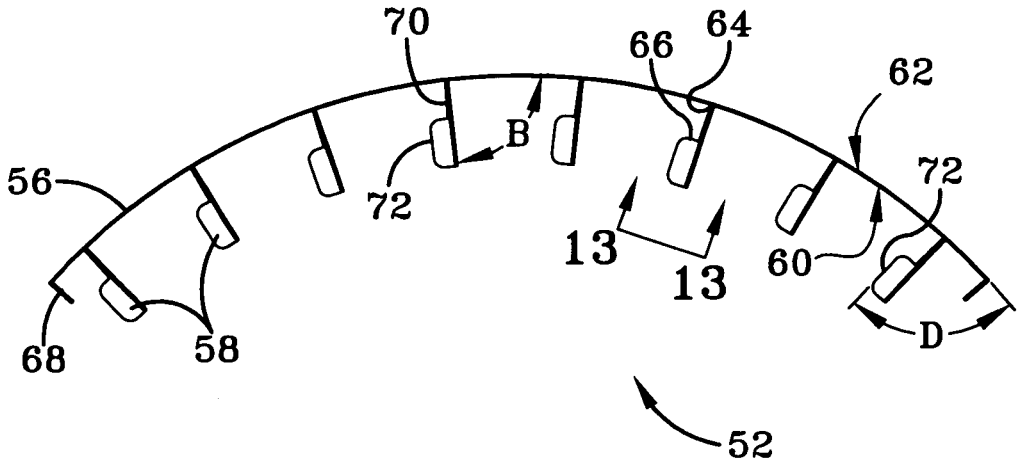
FIG. 12 is a top view of an embodiment of a flexible baffle insert, prior to disposition in a mixing vessel.

FIG. 12 is a top view of a portion of a flexible baffle insert 52. Insert 52 may include a retaining band 56 having inner and outer opposing surfaces 60, 62, respectively. A plurality of baffles 58 may extend inwardly from the inner surface 60 of the retaining band 56. Baffles 58 optionally may be spaced substantially equally on the retaining band 56. The total number of baffles 58 and their shape may be varied as needed for a particular process. A pair of tabs 68 may be disposed on opposite ends of the retaining band 56 and angled inwardly.

Figure 15B:
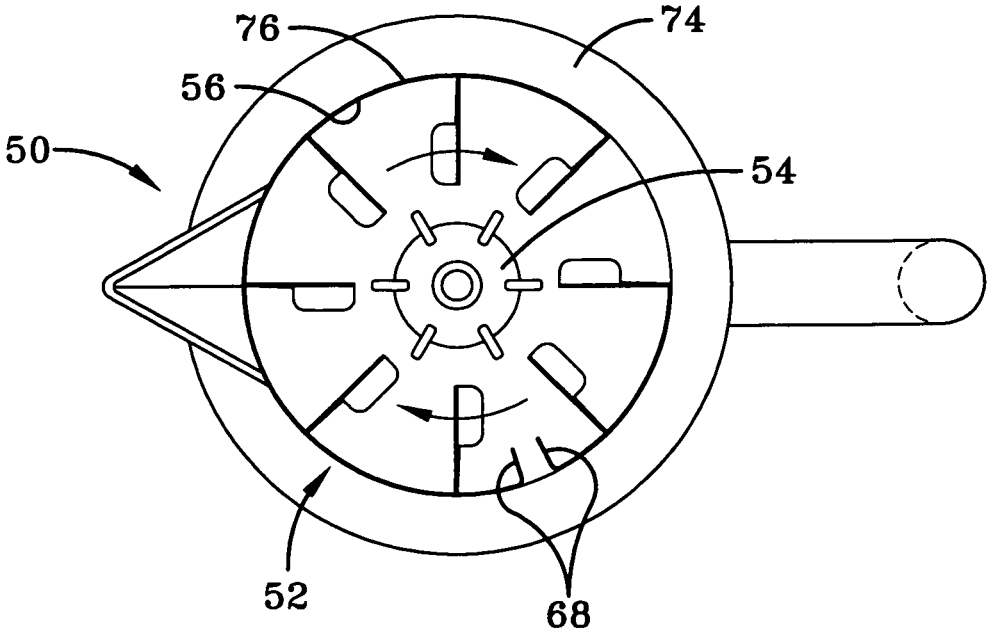
FIGS. 15A and 15B are side and top views, respectively, of a mixing vessel with an embodiment of a flexible baffle insert disposed therein.
Figure 15A:
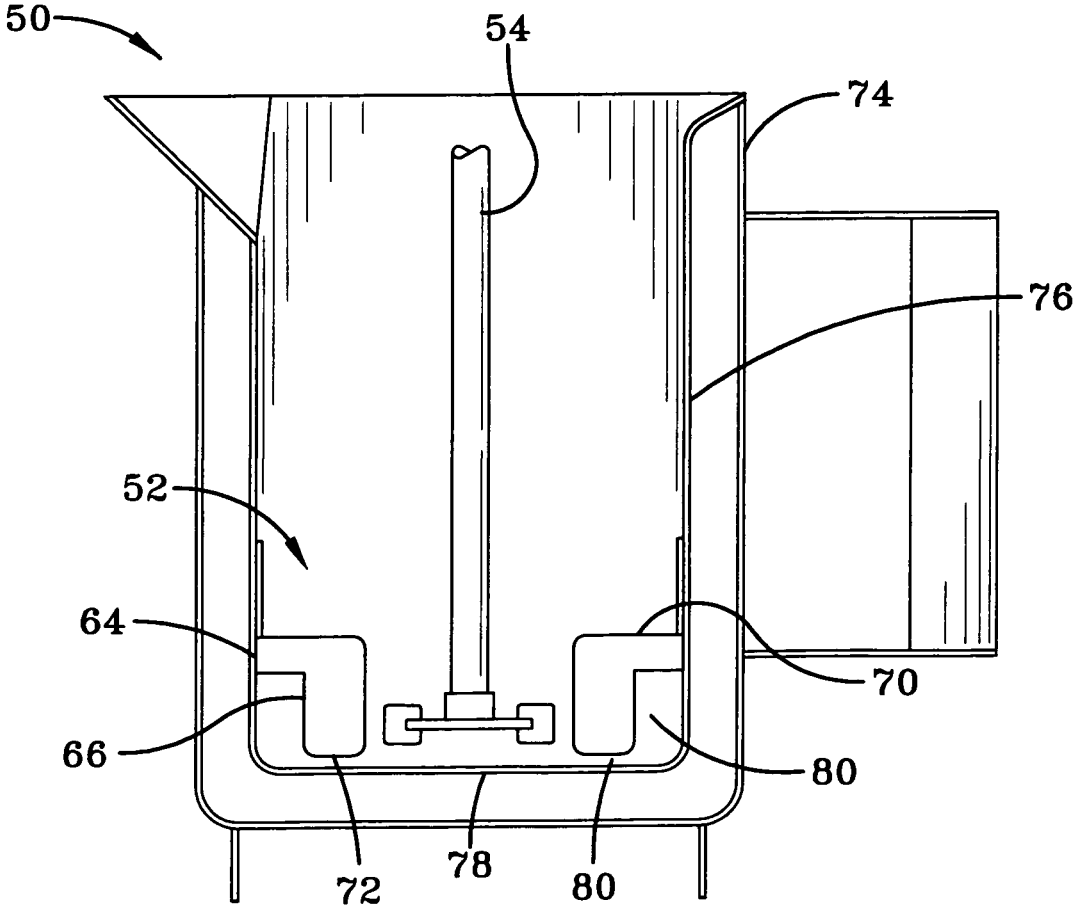

As best seen in FIGS. 12, 15A, and 15B, each baffle 58 may include a first edge 64 proximate the inner surface 60 of the retaining band 56 and a second edge 66 proximate the inner surface 60 of the retaining band 56. First edge 64 may be more proximate inner surface 60 than second edge 66. First (proximate) edge 64 may form a support joint with the inner surface 60 of the retaining band 56. Second (proximate) edge 66 may be displaced inwardly from the first (proximate) edge 64. The displacement of the second (proximate) edge 66 away from the first (proximate) edge 64 may provide a gap or open area 80 between a portion of baffle 58 and the side wall 76 of container 74. Gap 80 may be helpful in some mixing processes.

Each baffle 58 may include an upper edge 70 that forms an angle B (FIG. 12) with respect to the inner surface 60 of the retaining band 56. In FIG. 12, the angle B is about 90 degrees, for example. However, angle B may be other than ninety degrees. Each baffle 58 may include a lower edge 72 (see FIG. 14, also) that forms an angle D between the lower edge 72 of the baffle 58 and the inner surface 60 of the retaining band 56. When angles B and D are the same, the baffle 58 will be vertically oriented.

Figure 13:
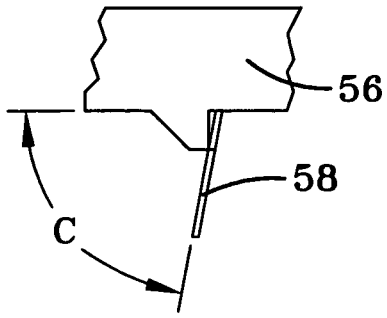
FIG. 13 is a view along the line 13-13 of FIG. 12.

In the exemplary embodiment shown in FIGS. 12, 15A, and 15B, angle D is larger than angle B, such that baffle 58 is "slanted." In the Figs., in an exemplary embodiment, angle B is about 90 degrees and angle D is about 110 degrees. Other exemplary values for angles B and D may be used. FIG. 13 is a view along the line 13-13 of FIG. 12 showing the slant of baffle 58 in a different perspective. Angle C in FIG. 13 is about 80 degrees, for example. Other exemplary values for angle C may be used.

Figure 14:
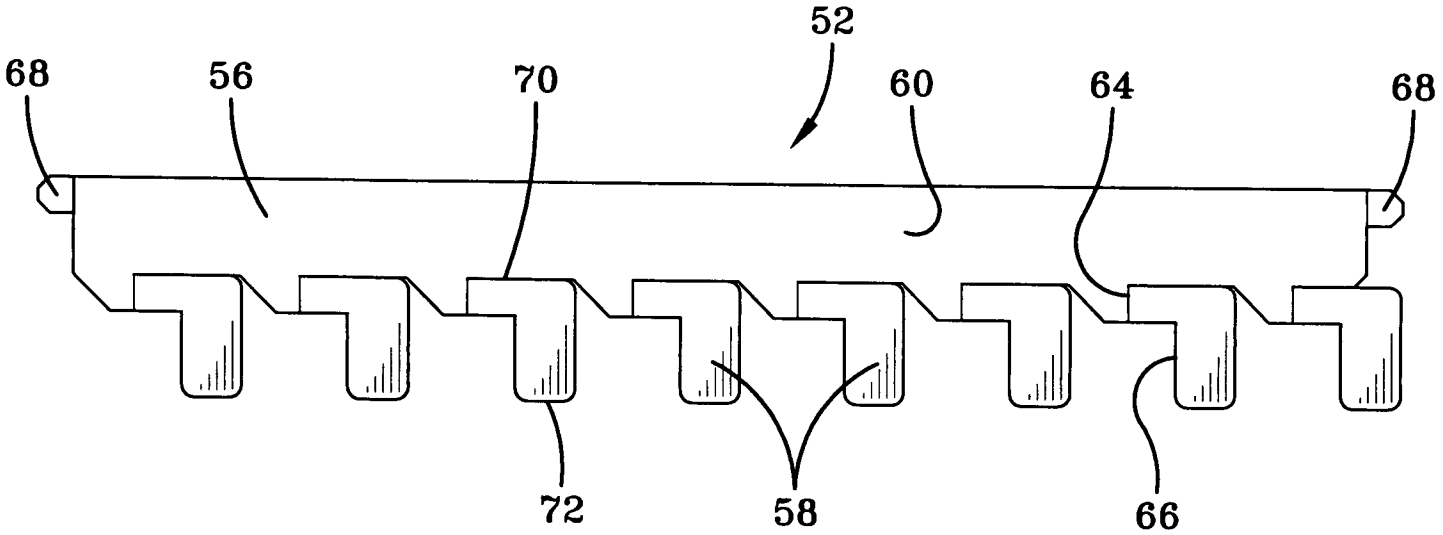
FIG. 14 is a side view of a baffle insert, prior to forming.

FIG. 14 is a side view of a flexible baffle insert 52, prior to preforming. In FIG. 14, baffles 58 are substantially coplanar with retaining band 56. Baffles 58 and retaining band 56 may be formed from a single sheet of material such as, for example, spring-temper brass shim stock. The shim stock may be, for example, about 0.015 inches thick. After stamping the shim stock to produce the configuration shown in FIG. 14, baffles 58 may be bent along edges 64 such that the baffles 58 are angled with respect to the retaining band 56. As noted above, baffles 58 may be bent so that upper edge 70 forms an angle B with retaining band 56. In FIG. 12, angle B is about 90 degrees, but other angles may be used. After bending baffles 58, each baffle 58 includes an edge 66 proximate the retaining band 56, but displaced away from the retaining band 56, that is, edge 64 is more proximate the retaining band 56 than edge 66.

If one desires a baffle insert 52 with baffles 58 that are not vertical, then one may further bend the baffles 58. One may further bend baffle 58 such that upper edge 70 of the baffle 58 forms an angle B with respect to the retaining band 56 that is different than an angle D of a lower edge 72 of the baffle 58 with respect to the retaining band 56. FIGS. 12, 13, 15A, and 15B show an embodiment where angle D is larger than angle B.

The retaining band may be bent into a curve approximately as shown in FIG. 12. This curve may have a radius that is larger than the radius of the interior of the mixing vessel 50. The retaining band 56 may be flexed into a circular shape by squeezing together the pair of tabs 68 disposed on opposite ends of the retaining band 56. Insert 52 may be inserted into a mixing vessel 50, and the pair of tabs 68 released. As the retaining band 56 expands, it grips the side wall 76 as shown in FIGS. 15A and 15B. In an iterative process, the insert 52 may be removed, its curvature may be adjusted, and it may be reinserted into vessel 50, until no gaps are visible between the retaining band 56 and the side wall 76.

FIGS. 15A and 15B are side and top views, respectively, of a mixing vessel 50 with a flexible baffle insert 52 disposed therein. Mixing vessel 50 may include a container 74 having a bottom 78 and a generally circular side wall 76. Mixing vessel 50 may have an impeller 54 disposed therein. Container 74 may be any type of container. FIGS. 15A and 15B show a standard, plain Groen jacketed container, by way of example, with a flexible baffle insert 52 therein.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A flexible baffle insert, comprising:

a retaining band having an inner surface and an outer surface, which are opposing surfaces and wherein the retaining band has a pair of tabs being formed with opposite ends of the retaining band, wherein the pair of tabs are angled in a direction outward from the inner surface; and a plurality of baffles extending inwardly from the inner surface of the retaining band, wherein each of said plurality of baffles includes a first edge and a second edge where the first edge and the second edge are proximate the inner surface, wherein the first edge forms a support joint with the inner surface of the retaining band, wherein the second edge is displaced in a direction outward from the inner surface from the first edge, wherein each of the plurality of baffles includes a lower edge, and wherein all of the plurality of the baffles are substantially in a same plane when the flexible baffle insert is inserted into a container.

2. The insert of claim 1, wherein the plurality of baffles are spaced substantially equally on the retaining band.

3. The insert of claim 1, wherein each of said plurality of baffles includes an upper edge that forms a first angle with respect to the inner surface of the retaining band.

4. The insert of claim 3, wherein the first angle of the upper edge with respect to the inner surface of the retaining band is substantially ninety degrees.

5. The insert of claim 3, wherein a second angle between the lower edge of the baffle and the inner surface of the retaining band is different than the first angle between the upper edge of the baffle and the inner surface of the retaining band.

6. A mixing vessel, comprising:

a container having a bottom and a generally circular side wall;

a flexible baffle insert being disposed in the container, wherein the flexible baffle insert comprises a retaining band having an inner surface and an outer surface, which are opposing surfaces when the flexible baffle insert is inserted into a container, and wherein the outer surface contacts an interior of said generally circular side wall, and a plurality of baffles extending inwardly from the inner surface of the retaining band, wherein each of the plurality of baffles includes a first edge and a second edge, where the first edge and the second edge are proximate the inner surface of the retaining band, wherein the first edge forms a support joint with the inner surface of the retaining band, wherein the second edge is displaced inwardly from the first edge to create a gap between the second edge and the interior of the generally circular side wall of the container, wherein each of the plurality of baffles includes a lower edge, and wherein all of the plurality of the baffles are substantially in a same plane.

7. The mixing vessel of claim 6, wherein the plurality of baffles are spaced substantially equally on the retaining band.

8. The mixing vessel of claim 6, wherein each of said plurality of baffles includes an upper edge that forms a first angle with respect to the inner surface of the retaining band.

9. The mixing vessel of claim 8, wherein the first angle of the upper edge with respect to the inner surface of the retaining band is substantially ninety degrees.

10. The mixing vessel of claim 8, wherein each of the plurality of baffles includes a lower edge, and wherein a second angle between the lower edge of the baffle and the inner surface of the retaining band is different than the first angle between the upper edge of the baffle and the inner surface of the retaining band.

* * * * *